US005322550A

United States Patent [19]

Park

[11] Patent Number: 5,322,550

[45] Date of Patent: Jun. 21, 1994

[54] ELECTRICAL DUST COLLECTOR

[75] Inventor: Eung-Lyul Park, Suweon-City, Rep. of Korea

[73] Assignee: Samsung Electronics, Co., Ltd., Suwon-City, Rep. of Korea

[21] Appl. No.: 24,217

[22] Filed: Mar. 1, 1993

[30] Foreign Application Priority Data

Feb. 28, 1992 [KR] Rep. of Korea ..... 92 3207

[51] Int. Cl.[5] ..... B03C 3/40

[52] U.S. Cl. ..... 96/66; 96/97

[58] Field of Search ..... 96/65, 66, 95, 97, 98, 96/69, 100

[56] References Cited

U.S. PATENT DOCUMENTS

| | | | |
|---|---|---|---|
| 2,195,431 | 4/1940 | Shively et al. | 96/97 X |
| 2,575,181 | 11/1951 | Mack | 96/100 X |
| 2,936,851 | 5/1960 | Cook | 96/66 |
| 3,418,792 | 12/1968 | Quintilian et al. | 96/100 |
| 3,550,852 | 12/1970 | Wallis | 96/97 X |
| 3,668,836 | 6/1972 | Richardson et al. | 96/66 |
| 3,820,306 | 6/1974 | Vincent | 96/66 X |
| 4,652,281 | 3/1987 | Masuda et al. | 96/69 |

*Primary Examiner*—Richard L. Chiesa

*Attorney, Agent, or Firm*—Burns, Doane, Swecker & Mathis

[57] ABSTRACT

An electrical dust collector includes a discharge plate of one polarity and a dust collect plate of an opposite polarity arranged one in front of the other with respect to an air flow. The discharge plate includes a base portion formed with partial cut-outs that are bent outwardly to form discharge electrodes. The dust collect plate includes a base portion formed with partial cut-outs that are bent outwardly to form dust collect electrodes. The discharge electrodes project in opposite directions relative to the dust collect electrodes and are arranged to face respective dust collect electrodes.

7 Claims, 5 Drawing Sheets

ELECTRICAL DUST COLLECTOR

BACKGROUND OF THE INVENTION

1. FIELD OF THE INVENTION

The present invention relates to an electrical dust collector, and more particularly to an electrical dust collector for electrically collecting and removing particle impurities, such as dust particles, in air.

2. Description of the Prior Art

Known domestic or office air conditioners have been generally used for conditioning room air optimally and provided with an air filter for purifying the room air by filtering off particle impurities, such as dust particles. However, the known air filter has a problem in that it can not filter off micro impurities, such as cigarette smoke.

In order to overcome such a problem of the known air filter, there has been proposed several types of electrical dust collectors. FIG. 1 shows a construction of a general type of known electrical dust collector. As shown in this drawing, the electrical dust collector generally includes a main body 1 provided with an inlet 1*a* and an outlet 1*b* at opposite ends thereof, respectively. In the main body 1 between the inlet 1*a* and the outlet 1*b*, a plurality of dust collect electrodes 3 and a plurality of discharge electrodes 4 are longitudinally alternately arranged such that they face and parallel to each other. These electrodes 3 and 4 are applied with high voltages of opposite polarities supplied by a high voltage generator 2. The known electric dust collector further includes a blower 5 disposed at a position near the outlet 1*b* for causing the air to be introduced into the body 1 through the inlet 1*a* and exhausted therefrom through the outlet 1*b* after purification.

In operation of this type of known electric dust collector, the electrodes 3 and 4 are applied with negative (−) voltage and positive (+) voltage, both supplied by the high voltage generator 2, respectively. Hence, an ionization field is formed between the electrodes 3 and 4. In this condition, when the room air reaches the ionization field as result of blower operation, the dust particles in the room air are ionized by the discharge electrodes 4, which are applied with the positive (+) voltage as aforementioned, and positively charged. This positively charged dust particles are then collected by the dust collect electrodes 3 which are applied with the negative (−) voltage. The dust particles in the room air are, therefore, removed from the room air and the purified air is exhausted from the main body 1 through the outlet 1*b*.

However, it has been noted that the dust collect efficiently of the known electric dust collector is remarkably affected by construction and arrangement of the dust collect electrodes 3 and the discharge electrodes 4.

With reference to FIG. 2, which is a perspective view of an embodiment of a dust collect part of the know electric dust collector, this dust collect part includes a charged plate 6 provided with a plurality of openings 6*a*. This dust collect part further includes a plurality of discharge electrode plates 7 each of which is integrally formed with a plurality of wedge-shaped electrodes 7*a* horizontally extending from a longitudinal side of the plate 7. Here, all of the discharge electrode plates 7 are arranged with respect to the charged plate 6 such that their wedge-shaped electrodes 7*a*face predetermined positions of individual openings 6*a*of the charged plate 6. In addition, a plurality of dust collect plates 8 are arranged between the discharge electrode plates 7 such that the plates 7 and 8 are alternately disposed. The discharge plates 7 and the dust collect plates 8 are applied with positive (+) voltage and negative (−) voltage from a high voltage generator (not shown), respectively. In the same manner as described in the electrical dust collector of FIG. 1, the dust particles in the room air passing through the collector are ionized with cations by the wedge-shaped electrodes 7*a* of the discharge plates 7 applied with the positive (+) voltage, and positively charged. These positively charged dust particles are then collected by the dust collect plates 8 applied with the negative (−) voltage. Thus, the dust particles are removed from the room air and the purification of the room air is achieved.

However, it is very difficult to position the discharge electrode plates 7 with respect to the charged plate 6 such that the wedge-shaped electrodes 7*a* of the plates 7 accurately face the predetermined positions of the individual openings 6*a* of the charged plates 6. This reduces productivity and increases manufacturing cost. Furthermore, the dust particles are collected and coated by the additionally mounted dust collect plates 8 and this causes another problem of the dust collector to be resided in that the dust collect efficiency is inevitably deteriorated.

SUMMARY OF THE INVENTION

It is, therefore, an object of the present invention to provide an electrical dust collector in which the above problems of the prior are can be overcome, and of which a charged plate for collecting ionized dust particles has a plurality of vertically erected dust collect electrodes spaced from and facing individual erected discharge electrodes of a discharge plate thereby causing the assembling of the charged plate with the discharge plate to be easily achieved.

It is another object of the present invention to provide an electrical dust collector which reduces manufacturing cost.

It is still another object of the present invention to provide an electrical dust collector which improves dust collect efficiency by introducing uniform discharge between dust collect electrodes and discharge electrodes.

In accordance with a preferred embodiment of the present invention, the above objects can be accomplished by providing an electrical dust collector for collecting and removing dust particles in a room air by ionizing said dust particles comprising a charged plate being adapted for collecting the ionized dust particles and being provided with a plurality of through holes each of which has an erected dust collect electrode provided at a side thereof; and a discharge plate being adapted for ionizing the dust particles and being arranged to face and to be spaced apart from the charged plate with a distance provided between them, and being provided with a plurality of discharge electrodes which are erected in an opposite direction to the dust collect electrodes of the

BRIEF DESCRIPTION OF THE DRAWINGS

Other objects and aspects of the invention will become apparent from the following description of embodiments with reference to the accompanying drawings in which:

FIGS. 3A and 3B show an embodiment of a charged plate of an electrical dust collector according to the present invention, respectively, in which:

FIG. 3A is an elevational view; and

FIG. 3B is a side view;

FIGS. 4A and 4B show an embodiment of a discharge plate of an electrical dust collector according to the present invention, respectively, in which:

FIG. 4A is an elevational view; and

FIG. 4B is a side view;

DETAILED DESCRIPTION OF THE PREFERRED EMBODIMENTS

Figure 2:
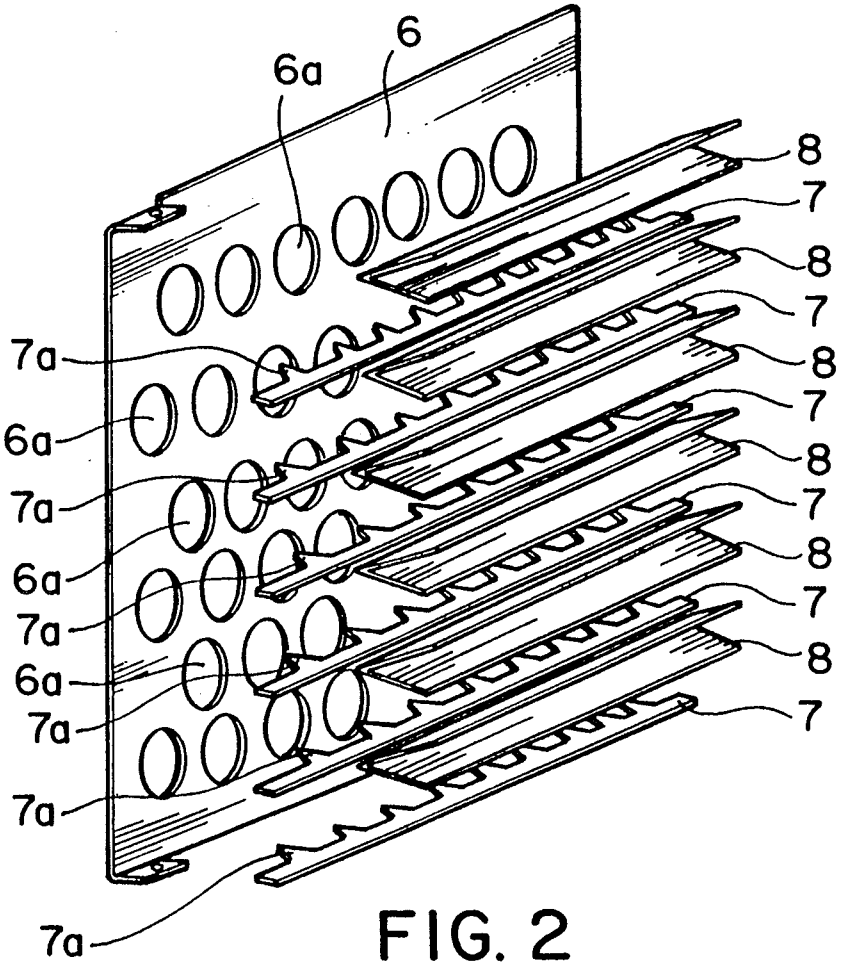
FIG. 2 (PRIOR ART)
FIG. 2 is a partially exploded perspective view of an embodiment of a dust collect part of a known electric dust collector.
Figure 1:
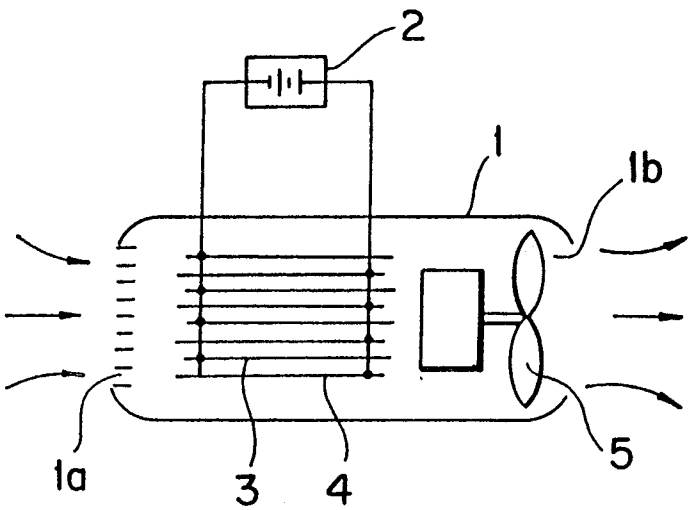
FIG. 1 (PRIOR ART)
FIG. 1 is a schematic view showing a construction of a general type of known electric dust collector.
Figure 3B:
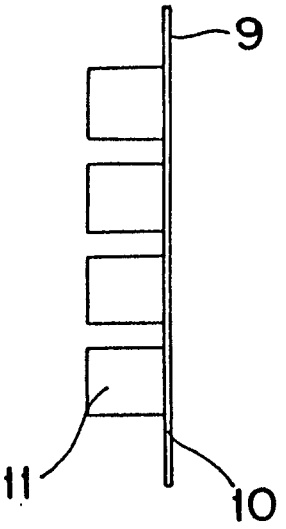
Figure 3A:
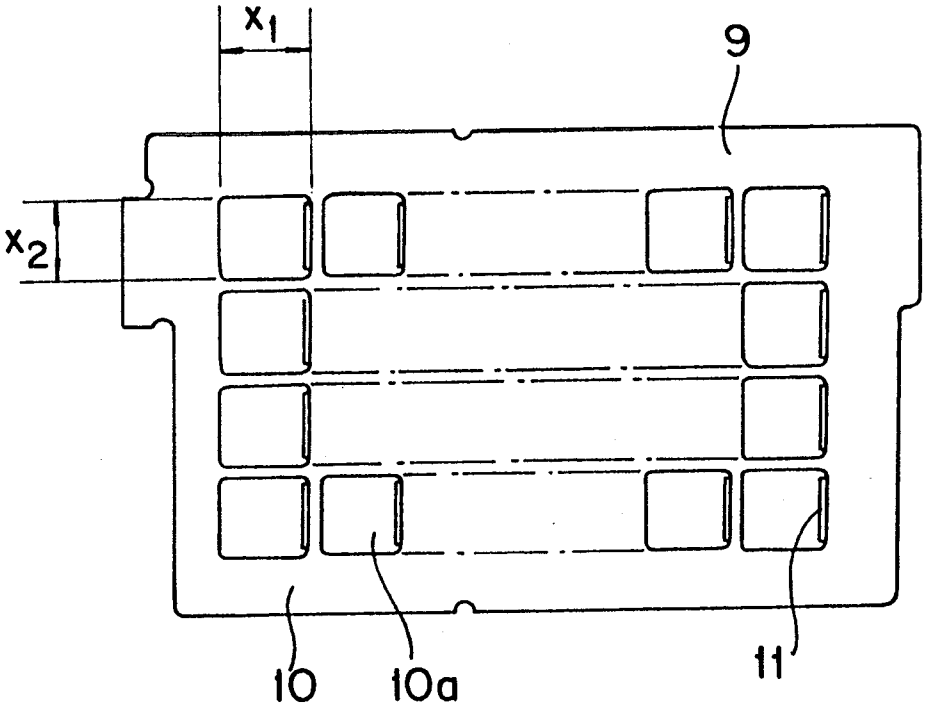

The electrical dust collector of the present invention includes a charged plate 10 shown in FIGS. 3A and 3B. As depicted in these drawings, the charged plate 10, which is used for collecting ionized and positively charged dust particles when it includes a base portion 9 applied with negative (−) voltage, is provided with a plurality of generally rectangular through holes 10*a*. The holes are square, i.e., the width $x_1$ and length $x_2$ of each hole 10*a* are equal to each other. In addition, this charged plate 10 is integrally provided with a plurality of dust collect electrodes 11 at individual through holes 10*a*. In order to provide the dust collect electrodes 11 for the charged plate 10, each of the holes 10*a* is cut at three sides, and thereafter, the remaining cut part is erected at the other side of the hole 10*a* such that this remaining cut part is perpendicular to the plane of the charged plate 10. This erected cut part functions as the dust collect electrode 11.

Figure 4B:
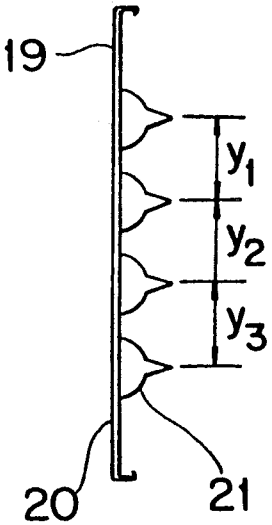
Figure 4A:
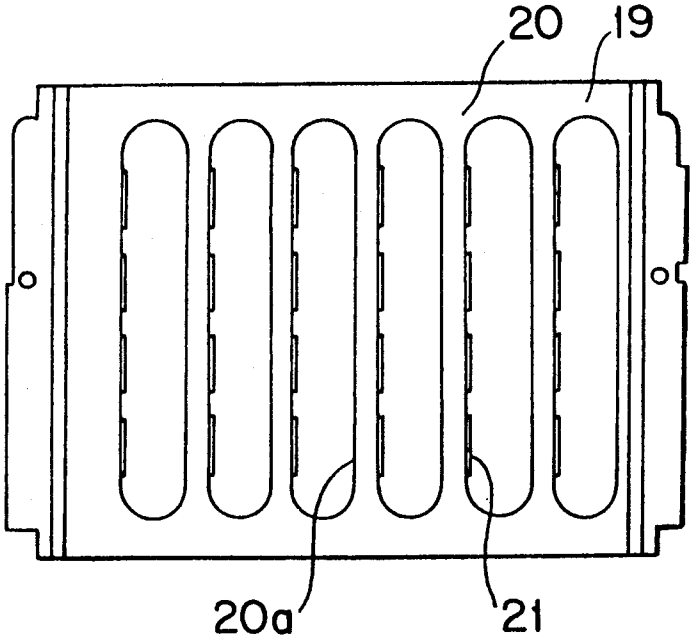

Turning to FIGS. 4A and 4B, there is shown a discharge plate 20 which is made of a stainless steel and used for ionizing the dust particles when it is applied with positive (+) voltage. As depicted in FIG. 4A, this discharge plate 20 includes a base portion 19 provided with a plurality of through-holes in the shape of longitudinal openings 20*a* each of which is integrally provided with a plurality of wedge-shaped discharge electrodes 21 at a side thereof. As best seen in FIG. 4B, these wedge-shaped discharge electrodes 21 have individual sharpened tips and are erected such that they are perpendicular to the discharge plate 20.

Here, it is preferred to form the discharge electrodes 21 such that the distances $y_1$, $y_2$ and $y_3$ between them are equal to each other.

Figure 5:
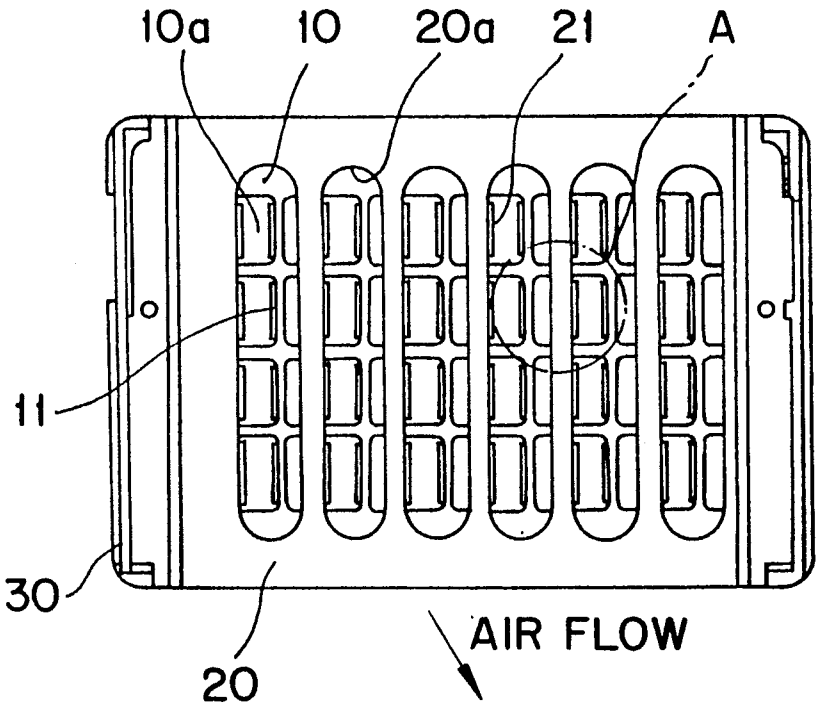
FIG. 5 is an elevational view of a dust collect part provided by assembling the charged plate with the discharge plate of the present invention.

Referring next to FIG. 5, the charged plate 10 and the discharge plate 20 are assembled into a dust collect part. In assembling the plates 10 and 20 into the dust collect part, the charged plate 10 is arranged in an insulating main body 30. The discharge plate 20 is, thereafter, arranged in the main body 30 such that the discharge plate 20 is parallel to and spaced apart from the charged plate 10 with a predetermined interval therebetween. As a result of such an assembling of the plates 10 and 20, the discharge electrodes 21 of the discharge plate 20 face individual dust collect electrodes 11 of the charged plate 10 in parallel and are spaced apart from the dust collect electrodes 11 by a predetermined distance.

Figure 6:
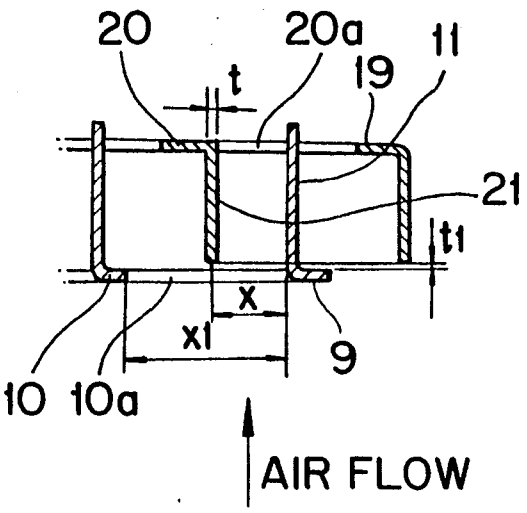
FIG. 6 is an enlarged sectional view of the circled section A of FIG. 5.

Otherwise stated, as best seen in FIG. 6, each of the discharge electrodes 21 is arranged between two dust collect electrodes 11 of the charged plate 10 so as to be parallel to the dust collect electrodes 11.

Here, when let the distance between the dust collect electrode 11 and the discharge electrode 21 be x, let the width and the length of the through hole 10*a* of the charged plate 10 be $x_1$ and $x_2$, respectively, let a thickness of the discharge electrode 21 be t, let the distances between the discharge electrodes 21 of the discharge plate 20 be $y_1$, $y_2$ and $y_3$, respectively, and let a gap between the charged plate 10 and the discharge electrode 21 be $t_1$, the distance x between the electrodes 11 and 21 should be determined to satisfy following relation (1)

$$x_1/2-t \leqq x \leqq x_1/2+t/2 \quad (1)$$

wherein $x_1=x_2$, $y_1=y_2=y_3$ and $t=t_1$.

Figure 7A:
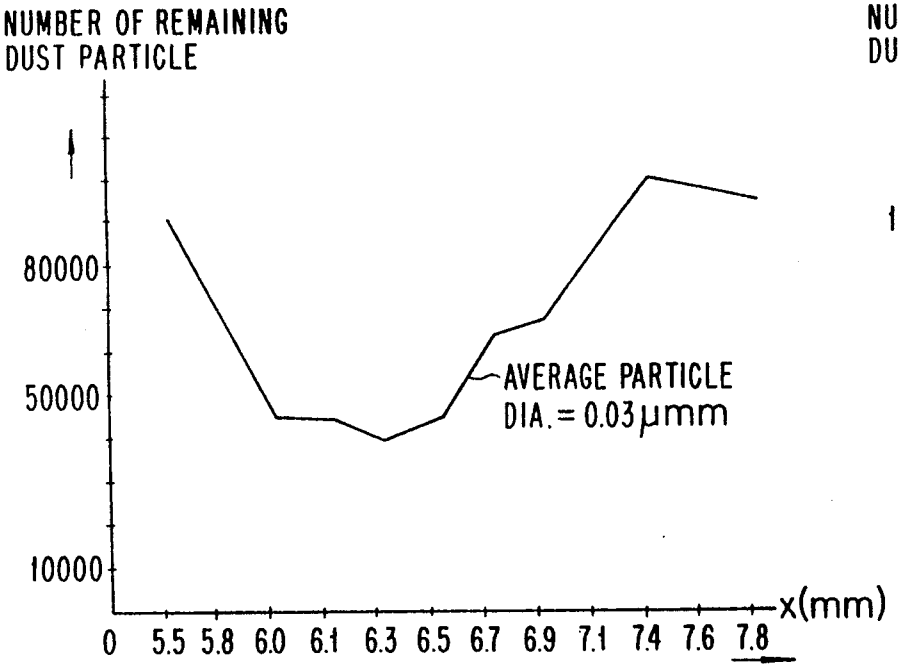
FIGS. 7A and 7B are graphs showing relation of dust collect efficiency of the electrical dust collector of the present invention as a functioning of a distance between a dust collect electrode of the charged plate and a discharge electrode of the discharged plate.
Figure 7B:
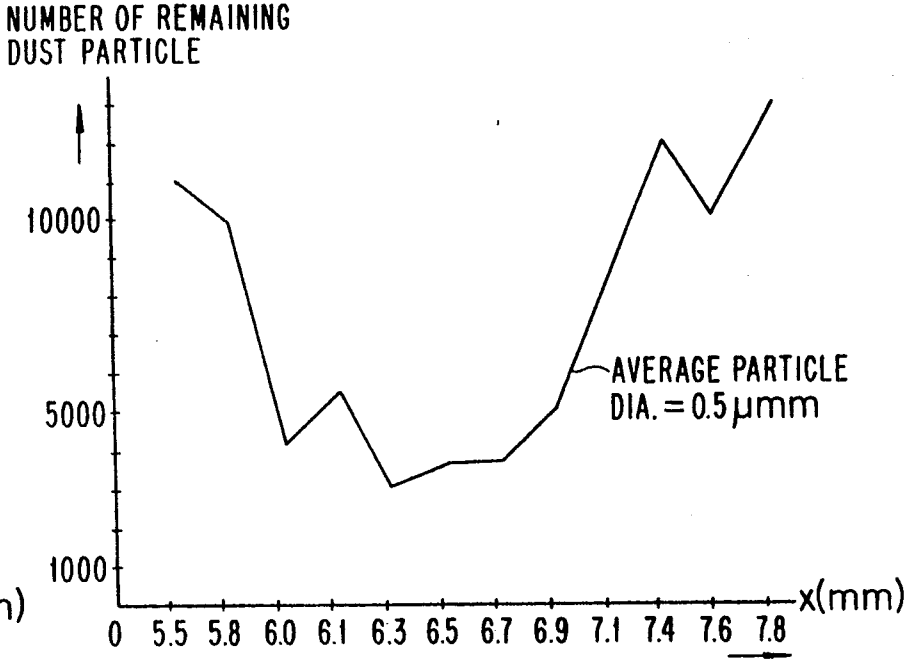

Referring to FIGS. 7A and 7B, there are shown graphs representing relation of dust collect efficiency of the electrical dust collector of this invention as a function of the distance x between the dust collect electrode 11 and the discharge electrode 21. As represented in FIG. 7A, the distance x of 6.0−6.5 mm produces the optimum dust collect efficiency of the dust collector when the average diameter of the dust particles in the room air is 0.3 μmm, and as indicated in FIG. 7B, the distance x of 6.0–6.9 mm produces the optimum dust collect efficiency of the dust collector when the average diameter of the dust particles is 0.5 μmm.

Hereinafter, the operational effect of the present electrical dust collector will be described.

Upon applying the positive (+) voltage to the discharge plate 20 at the same time of applying the negative (−) voltage to the charged plate 10, uniform electric potential and uniform electric field are provided between the plates 10 and 20. Such a uniform electric potential as well as the uniform electric field is provided because the dust collect electrodes 11 of the charged plate 10 and the discharge electrodes 21 of the discharge plate 20 are characteristically arranged, as aforementioned, such as that no wedge-shaped electrode is disposed in the through holes 10*a* of the charged plate 10.

The uniform electric potential and the uniform electric field prevent generation of corona discharge and this causes uniform discharge between the charged plate 10 and the discharge plate 20. Hence, the room air containing dust particles passing by the discharge electrodes 21 and passing through the through holes 10*a* of the charged plate 10 are applied with the high frequency of 800 Hz–1500 KHz. This causes the dust particles to be divided into micro particles which are in turn charged with cations. These positively charged micro dust particles are easily collected by the negatively charged plate 10.

As described above, the present invention provides an electrical dust collector which includes a discharge plate provided with a plurality of longitudinal openings, each having a plurality of vertically erected discharge electrodes having individual sharpened tips. The present dust collector further includes a charged plate having a plurality of through holes provided with individual dust collect electrodes. The discharge plate and the charged plate are assembled into a dust collect part such that the discharge electrodes of the discharge plate face individual dust collect electrodes of the charged plate in parallel and are spaced apart therefrom by a predetermined distance. Hence, the present invention causes a uniform discharge between the dust collect electrodes and the discharge electrodes and, as a result, provides an advantage in that the dust collect efficiency of the dust collector is remarkably improved. Furthermore, the charged plate and the discharge plate can be easily assembled. Thus, another advantage of this invention is resided in that the manufacturing cost of the electrical dust collector is reduced.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electrical dust collector for removing dust particles from an air flow by ionizing the dust particles and then attracting the ionized dust particles, said collector comprising:

a discharge plate for ionizing the dust particles, said discharge plate including a first base portion having first through-holes therein, and spaced-apart discharge electrodes projecting perpendicularly from said first base portion adjacent said first through-holes, said discharge electrodes being of one-piece construction with said first base portion adjacent ones of said discharge electrodes forming spaces therebetween, and a charged plate of opposite polarity from said discharge plate for collecting ionized dust particles, said charged plate including a second base portion having second through-holes therein, and spaced apart dust collect electrodes projecting perpendicularly from said second base portion adjacent said second through-holes, said dust collect electrodes being of one-piece construction with said second base portion and arranged parallel to said discharge electrodes and positioned within respective ones of said spaces, whereby said dust collect electrodes face respective discharge electrodes.

2. An electrical dust collector according to claim 1, wherein each discharge electrodes comprises a partial cut-out which is bent outwardly from said first base portion, and each dust collect electrode comprises a partial cut-out which is bent outwardly from said second base portion.

3. An electrical dust collector according to claim 1, wherein said first through-holes are offset with respect to said second through-holes in the same direction as the spacing between a discharge electrode and its respective dust collect electrode.

4. An electrical dust collector according to claim 3, wherein there is provided one dust collect electrode for each second through-hole.

5. An electrical dust collector according to claim 4, wherein each first through-hole comprises a longitudinally elongated opening, there being a plurality of said discharge electrodes disposed at each first through-hole.

6. An electrical dust collector according to claim 1, wherein said discharge electrodes are of wedge-shape having a sharpened tip.

7. An electrical dust collector according to claim 1, wherein said discharge electrodes extend toward said second through-holes, and said dust collect electrodes extend toward said first through-holes.

* * * * *